United States Patent [19]

Riedel

[11] 4,062,553

[45] Dec. 13, 1977

[54] DEVICE FOR SECURING A PAIR OF SKIS TOGETHER

[75] Inventor: Tilo Riedel, Eching, Germany

[73] Assignee: S.A. Etablissements Francois Salomon & Fils, Annecy, France

[21] Appl. No.: 665,373

[22] Filed: Mar. 10, 1976

Related U.S. Application Data

[63] Continuation-in-part of Ser. No. 557,476, March 12, 1975, Pat. No. 3,989,271.

[30] Foreign Application Priority Data

| | | |
|---|---|---|
| Mar. 15, 1974 | Germany | 2412623 |
| July 26, 1974 | Germany | 2436155 |
| Feb. 20, 1975 | Germany | 2507371 |

[51] Int. Cl.[2] ..... A63C 11/02

[52] U.S. Cl. ..... 280/11.37 A; 280/605

[58] Field of Search ..... 280/605, 11.37 A

[56] References Cited

U.S. PATENT DOCUMENTS

| | | | |
|---|---|---|---|
| 3,940,158 | 2/1976 | Wehrli | 280/605 |
| 3,964,760 | 6/1976 | Riedel | 280/605 |
| 3,989,271 | 11/1976 | Riedel | 280/605 |

FOREIGN PATENT DOCUMENTS

| | | | |
|---|---|---|---|
| 224,227 | 7/1943 | Switzerland | 280/11.37 A |

*Primary Examiner*—Joseph F. Peters, Jr.
*Assistant Examiner*—David M. Mitchell
*Attorney, Agent, or Firm*—Karl F. Ross

[57] ABSTRACT

A pair of skis are secured together by providing notched blades of a ski brake designed to prevent free flight of the ski down a slope, e.g. upon the falling of a skier. The notches in the blades are dimensioned so that when the blades straddle the respective skis, the notches of the blades of each pair of brake elements can receive the longitudinal edges of the other ski of the respective pair so that the skis are held in runner-to-runner relationship.

14 Claims, 7 Drawing Figures

Fig.1
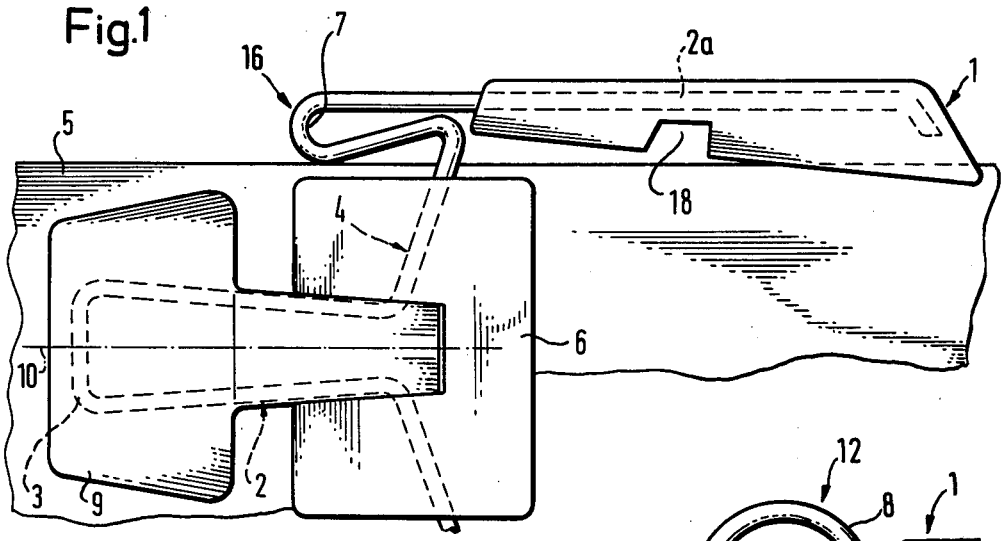
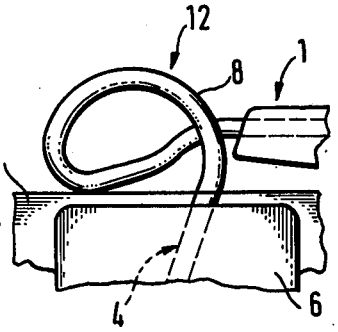
Fig.1a
Fig.2
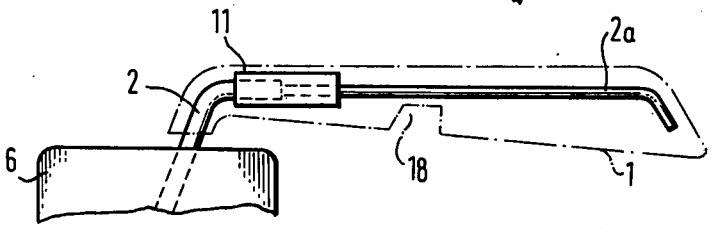
Fig.3
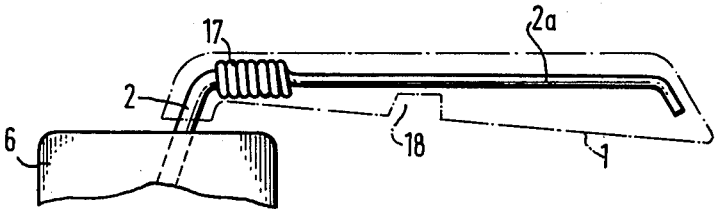
Fig.4
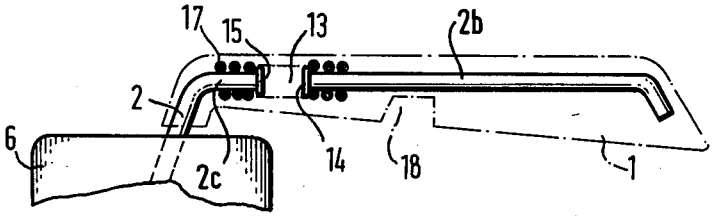

DEVICE FOR SECURING A PAIR OF SKIS TOGETHER

CROSS-REFERENCE TO RELATED APPLICATION

This application is a continuation-in-part of my copending application Ser. No. 557,476 filed Mar. 12, 1975 and entitled "Automatic Brake for Ski", now U.S. Pat. No. 3,989,271.

FIELD OF THE INVENTION

The present invention relates to a device for holding a pair of skis and, more particularly, to a novel arrangement for retaining the skis of a pair in runner-to-runner relationship.

BACKGROUND OF THE INVENTION

For the retention of skis of a pair together, so as to enable them to be transported and stored readily, various devices have been used heretofore. For example, leather straps are used most widely and can be slung around the skis when they are placed with their running faces in abutting relationship. There are ski "clips" for this purpose as well which comprise rubber bands with approximately U-shaped hooks engageable with the edges of one ski and stretching to engage the edges of the other ski. The straps and bands must be carried apart from the skis when the latter are in use, are frequently lost, and are not inexpensive.

OBJECTS OF THE INVENTION

It is an object of the present invention to provide an improved ski arrangement whereby the aforementioned disadvantages can be obviated.

Another object of this invention is to provide an improved for retaining the skis of a pair together for transport and storage.

Still another object of the invention is to advance the principles set forth in my copending application Ser. No. 557,476 mentioned above.

SUMMARY OF THE INVENTION

These objects and other which will become apparent hereinafter are attained, in accordance with the present invention, by providing the ski-holding device in the form of a pair of brake elements of a ski mounted upon the upper or boot-receiving surface of the skis and formed with notches adapted to receive the longitudinal edges of the other ski of the pair when the brake elements are swung into their operative positions in which they straddle the longitudinal edges of the ski on which they are mounted.

The notches or recesses on the inner edges of the brake elements are dimensioned to accommodate a longitudinal edge of the other ski so that the two skis can be brought together in runner-to-runner relationship with their respective ski brake elements engaging the longitudinal edges of the opposing ski or of its brake. Since the inner longitudinal edges of the brake elements are notched, they receive the outer longitudinal edges of the opposing skis.

The simple construction, which involves minimal expense in the fabrication of the ski brake, insures that the skier will always have available a means for securing the brakes together so that the ski brake itself can replace the straps or bands heretofore used for joining a pair of skis together.

As described more fully in the above-identified application, a ski which is released from a ski boot on a slope can engage in free flight and at high speeds poses a danger to other skiers. For this reason it has been proposed to provide the ski with an automatic ski brake which is retained in its inoperative position by application of the ski boot against the ski, e.g. against a spring force tending to bias an actuator into an operative position.

The actuator may be engaged by the toe or heel of the ski boot when the latter is properly received in the ski binding.

The actuator is provided with one or two brake elements which are constituted as blades and swing from their inoperative positions, in which they permit ordinary skiing, into operative positions in which they engage the ground and prevent free flight of the ski when the actuator is released by the ski boot.

Such devices are referred to hereinafter generally as ski brakes and, while I prefer to utilize for the purposes of the present invention, the blades or brake elements of ski brakes having the configuration described in the above identified application, it should be noted that the principles are applicable to other types of ski brakes as well.

Ski brakes generally have an actuator which is biased under a primary spring force from the inoperative position toward the operative position, in a mounting plate which can be affixed to the upper surface of the skis. In one such ski brake, which is mounted behind the binding in a bearing or journal arrangement, the pivot axis includes an acute angle with the longitudinal axis of the ski and the basic spring force is generated by a torsion spring which acts upon the blade-like brake element.

In another conventional construction, leaf springs are secured at their forward ends to the ski and at their rearward ends tend to bend upwardly when they are unloaded. Upon loading by the ski boot these spring elements are urged toward the upper surface of the ski to swing the blades into positions generally parallel to the ski edges. A device of this type is described in Austrian Pat. No. 299,036.

Other ski brakes are described in Austrian Pat. Nos. 280,867 and 210,804. Austrian Pat. No. 305,844 describes a ski brake having a spring which, upon the release of an actuator, rotates a shaft extending transversely to the ski about the shaft axis, to bring the blade into play.

A ski brake which can be fitted with a notched blade according to the invention is also described in German published application (Offenlegungsschrift) No. 2,417,279 in which the ski brake is shown to be mounted by a support plate on the upper surface of the ski and to comprise a wire bent into a loop with pivot portions received in a pair of parallel recesses so that, when the loop is pressed against the upper surface of the ski, a prestressing is applied which permits the brake to swing into its operative position once the boot releases this actuator.

Preferably, however, the ski brake with which the present invention is used, is of a type described in my application Ser. No. 557,476 and comprises a stirrup-shaped bent spring wire having a bight portion which can be actuated by the ski boot directly or through a tread plate or treadle, and a pair of shanks extending from the bight, the shanks lying in a plane which, in the inoperative position of the ski brakes, is generally parallel to the plane of the upper surface of the ski.

The shanks are formed with angularly bent portions, converging inwardly toward one another or diverging from one another and received in respective passages of a support plate or of the ski itself, these offset portions lying outside this aforementioned plane of the bight, so that, when the bight is pressed towards the upper ski surface, the spring wire is deformed and loaded.

The blade or brake elements (preferable two in number) are mounted upon the spring wire, or along the shank portion between the bight and the bend or at a free end of the bend or or offset portion. The bent spring wire may have legs which are bent from the offset portion to be received in or by the brake elements.

BRIEF DESCRIPTION OF THE DRAWING

The above and other objects, features and advantages of the present invention will become more readily apparent from the following description, reference being made to the accompanying drawing in which:

FIG. 1 is a fragmentary elevational view, partly in diagrammatic form, of a portion of a ski brake provided with a ski-retaining notch according to the invention;

FIG. 1 a is a detail view of a modification of the structure of FIG. 1;

FIGS. 2–4 are detail views of other spring arrangements for the junction between the brake element and the main spring wire;

SPECIFIC DESCRIPTION

In the following descripton reference will be made to a ski structure and it should be made understoood that the ski brake structure is given in all necessary detail in the above identified application which is hereby incorporated by reference herein.

Figure 5:
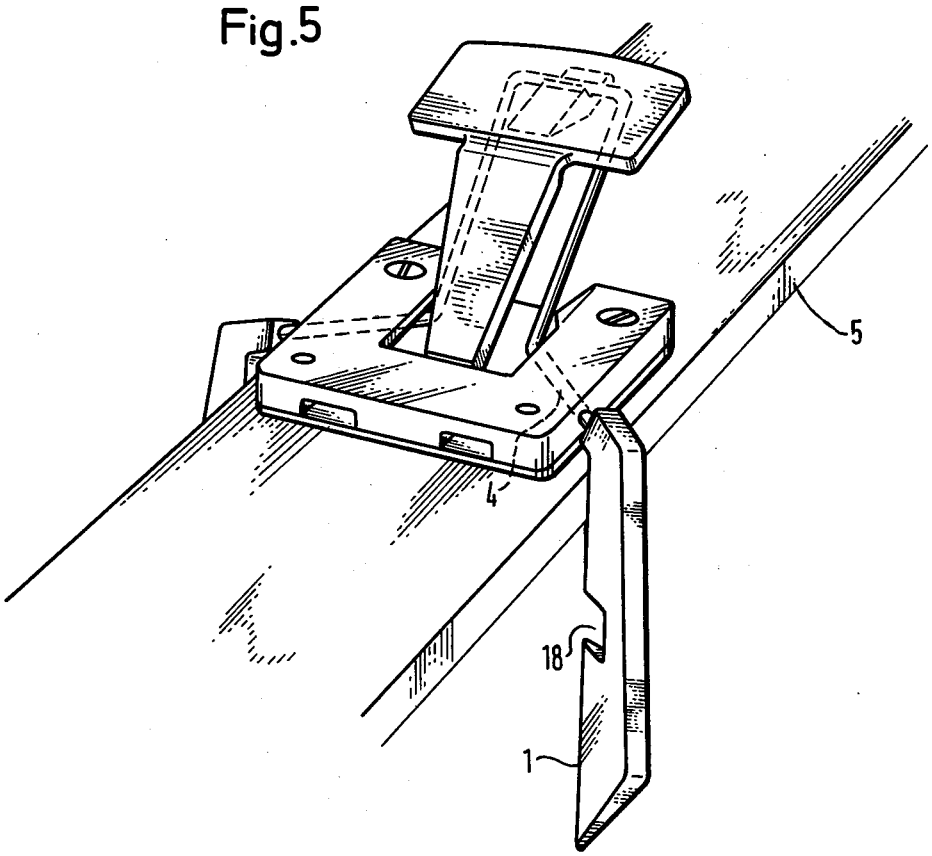
FIG. 5 is a perspective view of the ski brake of FIG. 1 in its operative position.

According to the present invention the brake element 1 of a ski brake is a blade providing a recess or cutout (notch) 18 of generally trapezoidal configuration to correspond to the cross section of a longitudinal edge of ski 5 so that, when the ski brake is in its operative position as shown in FIG. 5, it can engage the longitudinal edge of a second ski disposed with its running surface in face to face relationship with the first ski 5.

Figure 6:
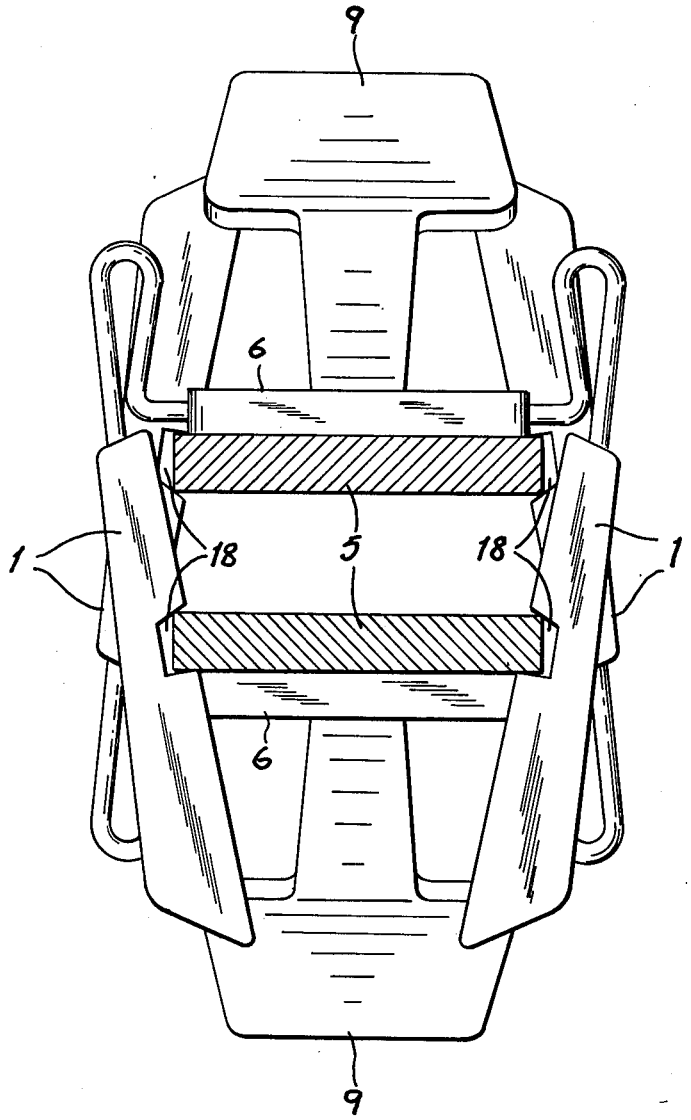
FIG. 6 is a cross-sectional view showing how a pair of skis can be fitted together, being retained by the blades of their ski brakes.

As can be seen from FIGS. 1 and 6, the blade 1 has an inner edge (formed with the notch 18) which, when the blade is swung, about a laterally angled axis formed by the pivot portion of the offset shank 4, downwardly to straddle the longitudinal edge of the ski, lies somewhat inwardly of this edge and hence can receive the corresponding edge of the other side of the pair to be disposed in face-to-face relationship described previously.

The recess 18 have the necessary spacing and position to permit the other ski to be passed into these recesses and to be retained in the proper relatonship with the first ski. The brake element 1 can grip the other ski with a certain spring force if, as shown in FIG. 5, it is tilted generally in the counterclockwise direction about the pivot portions formed by the offset shanks 4. Thus in its normal braking position, the ski brake of FIG. 5 may be effective while its brake elements 1 are tilted rearwardly as shown, but upon further tilting in a somewhat more forwardly direction, e.g. to bring the brake elements 1 perpendicular to the ski surface, the brake elements will grip the other ski in their notches 18 with a resilient force generated by deformation of the spring wire 2.

As can be seen from FIGS. 1 through 4 the ski brake can comprise generally a mounting plate 6 affixed to the upper surface of a ski 5 and receiving, in respective passages, the angularly offset bent portions 4 of a spring-wire stirrup 2 which has a bight 3. The bight lies in a plane while the offset members 4 extend out of the plane so that pressing of the bight 3 towards the upper surface of ski 5 will deform the spring wire stirrup 2 (as the offset portions and bright approach coplanarity) and swing the brake element 1 upwardly. The distortion of the spring wire preloads the latter, so that, when the ski boot is removed from engagement with the ski brake, the elements 1 swing downwardly automatically to straddle the ski and function as a ski brake to prevent free flight. In a released position, moreover, the ski brake serves to retain a second ski in runner-to-runner relationship with the first ski.

As is apparent from the aforementioned U.S. Pat. No. 3,989,271, a second elastic member or spring element can be provided between the brake element 1 and the spring wire 2 to cushion shock and prevent overloading of the spring wire. Surprisingly, when the brake elements 1 are used to retain a second ski and thereby pair the skis for transport and storage, this additional elastic member can contribute some of the elastic force retaining the skis together. Such elastic members are more fully described in connectin with FIGS. 1 through 4.

The ski brake is symmetrical about the longitudinal axis 10 of a ski 5 and can be provided with a treadle or tread plate 9 which acts upon the bight 3 and assist the boot to hold the bight down in the inoperative position of the ski. The treadle 9 is swingably mounted in the plate 6.

In FIG. 1 the additional elastic member 16 comprises an elongated loop 7 formed directly in the stirrup-shaped spring wire 2 at the junction between the offset portion 4 and the brake element 1.

The additional elastic member 12 in FIG. 1*a* comprises a spiral loop 8 formed in the spring wire 2 between the offset portion 4 and the brake element 1.

FIG. 2 shows how the spring element 2 can terminate at the junction with the brake element 1 while the additional elastic member is formed in part by a thinner wire 2*a* extending through or along the remainder of brake plate 1. The wires 2 and 2*a* can have different moduluses of elasticity and the wire 2*a* may be welded to the wire 2. In addition a sleeve 11, preferably of elastic material, may be fitted snugly around the adjoining ends of wires 2 and 2*a*.

The auxiliary spring member in FIG. 3 comprises a coil spring 17 wound upon the thin wire 2*a* running through the brake element 1, and snugly engaging the end of wire 2. A weld can also be provided here between the end of the coil spring 17 and wire 2.

Another arrangement utilizes a coil spring 17 to bridge a gap 13 between a wire 2*b* running along the brake element 1 and spaced from the end 2*c* of the spring wire 2. The proximal ends of wire portions 2*b* and 2*c* can be provided with disks 14 and 15 which can be received between turns of the spring 17 where it is desired to adjust the width of gap 13.

I claim:

1. A device for securing the skies of a pair together, each of said skis having a pair of longitudinal edges, comprising:

a ski brake mounted on one of said ski and including an actuator, a brake element in the form of an elongated blade operatively connected with said actuator for displacement thereby into a position wherein said blade element extends athwart a longitudinal edge of said one of said skis, and spring means biasing said actuator and said brake element into said operative position; and a notch formed along an inner edge of said blade and adapted to receive the longitudinal edge of the other ski when said skis are position in runner-to-runner relationship and said ski brake is in its operative position.

2. The device defined in claim 1 wherein another such ski brake is provided on said other ski and likewise has a brake element in the form of an elongated blade formed with a notch, the latter notch receiving a longitudinal edge of said one of said skis.

3. The device defined in claim 2 wherein each of said ski brakes is formed with a respective pair of such brake elements straddling the respective ski and provided with respective notches to receive the opposite longitudinal edges of an opposing ski.

4. The device defined in claim 1 wherein said spring means includes a bent spring wire formed with a bight lying in one plane and an angularly bent offset portion out of said plane and retained on said one of said skis for deformation of said wire upon the pressing of said bight toward an upper surface of said ski.

5. The device defined in claim 4 wherein said brake element is affixed to said offset portion.

6. The device of claim 5, further comprising an additional elastic member interposed between said brake element and said spring wire at the junction between said offset portion and said element to cushion forces transmitted to said spring wire upon impact with said brake element.

7. The device defined in claim 6 wherein said spring wire terminates at said junction, said additional elastic member comprising a wire thinner than said spring wire and secured to said spring wire at said junction while extending along said brake element.

8. The device defined in claim 7 wherein the thinner wire is secured to the thicker wire at said junction at least in part by a sleeve receiving ends of both said wires.

9. The device defined in claim 8 wherein said sleeve in composed of an elastic material.

10. The device defined in claim 8 wherein the thicker wire has a different modulus of elasticity than the thinner wire.

11. The device defined in claim 7 wherein the thinner wire is formed with a coil spring receiving the thicker wire.

12. The device in claim 6 wherein said spring wire terminates at said junction and said element is formed with a further wire spaced from said spring wire at said junction, said additional elastic member comprising a coil spring receiving the ends of both said wires at said junction and bridging the gap between said wires.

13. The device defined in claim 6 wherein said additional elastic member is a loop formed in said spring wire between said offset portion and said blade.

14. The device defined in claim 13 wherein said loop has a spiral configuration.

* * * * *

Disclaimer 4,062,553.—*Tilo Riedel,* Eching, Germany. DEVICE FOR SECURING A PAIR OF SKIS TOGETHER. Patent dated Dec. 13, 1977. Disclaimer filed Mar. 2, 1981, by the assignee, *S. A. Etablissements Francois Salomon & Fils.*

The term of this patent subsequent to June 22, 1993, has been disclaimed.

[*Official Gazette April 7, 1981.*]